United States Patent [19]
Cha
[11] 4,224,990
[45] Sep. 30, 1980

[54] METHOD FOR FLATTENING THE COMBUSTION ZONE IN AN IN SITU OIL SHALE RETORT BY THE ADDITION OF FUEL

[75] Inventor: Chang Y. Cha, Bakersfield, Calif.

[73] Assignee: Occidental Oil Shale, Inc., Grand Junction, Colo.

[21] Appl. No.: 4,938

[22] Filed: Jan. 19, 1979

[51] Int. Cl.² ..... E21B 43/24
[52] U.S. Cl. ..... 166/256; 166/251; 166/259
[58] Field of Search ..... 166/256, 259, 272, 247, 166/260; 299/2

[56] References Cited

U.S. PATENT DOCUMENTS

| | | | |
|---|---|---|---|
| 3,001,776 | 9/1961 | Van Poollen | 166/256 X |
| 3,097,690 | 7/1963 | Terwilliger et al. | 166/256 |
| 3,127,935 | 4/1964 | Poettmann et al. | 166/260 |
| 3,147,804 | 9/1964 | Wyllie | 166/259 X |
| 3,154,143 | 10/1964 | Parrish | 166/256 |
| 3,454,958 | 7/1969 | Parker | 166/272 X |
| 3,460,620 | 8/1969 | Parker | 166/247 UX |
| 3,548,938 | 12/1970 | Parker | 166/256 |
| 4,084,640 | 4/1978 | Allred | 166/259 |

FOREIGN PATENT DOCUMENTS 17162 7/1976 Morocco .

*Primary Examiner*—Stephen J. Novosad
*Attorney, Agent, or Firm*—Christie, Parker & Hale

[57] ABSTRACT

A secondary combustion zone is established and its location controlled in a fragmented mass of particles containing oil shale in an in situ oil shale retort.

A processing zone including a primary combustion zone is established in the retort by igniting a portion of the mass of particles. An oxygen supplying gas is introduced into the retort to advance the processing zone through the fragmented mass. If the primary combustion zone is not substantially planar or has not progressed uniformly, a secondary combustion zone is established upstream of the primary combustion zone by introducing into the retort a retort inlet mixture comprising fuel and at least sufficient oxygen for combustion of the fuel at a temperature no greater than the primary combustion zone temperature.

The secondary combustion zone is caused to move upstream from its initial location in the in situ oil shale retort by reducing the ignition temperature of the retort inlet mixture. The secondary combustion zone is maintained at this upstream location and allowed to spread laterally through the fragmented mass, heating portions of such fragmented mass to the self-ignition temperature of oil shale. Heating the fragmented mass to the self-ignition temperature of oil shale spreads the primary combustion zone laterally across the fragmented mass at the upstream location.

48 Claims, 2 Drawing Figures

METHOD FOR FLATTENING THE COMBUSTION ZONE IN AN IN SITU OIL SHALE RETORT BY THE ADDITION OF FUEL

BACKGROUND OF THE INVENTION

The presence of large deposits of oil shale in the Rocky Mountain region of the United States has given rise to extensive efforts to develop methods of recovering shale oil from kerogen in the oil shale deposits. It should be noted that the term "oil shale" as used in the industry is in fact a misnomer; it is neither shale nor does it contain oil. It is a semdimentary formation comprising marlstone deposit with layers containing an organic polymer called "kerogen", which upon heating decomposes to produce liquid and gaseous products including hydrocarbon products. It is the formation containing kerogen that is called "oil shale" herein, and the liquid hydrocarbon product is called "shale oil".

A number of methods have been proposed for processing oil shale which involve either first mining the kerogen bearing shale and processing the shale on the surface, or processing the shale in situ. The latter approach is preferable from the standpoint of environmental impact since the spent shale remains in place, reducing the chance of surface contamination and the requirement for disposal of solid wastes. According to both of these approaches, oil shale is retorted by heating the oil shale to a sufficient temperature to decompose kerogen and produce shale oil which drains from the rock. The retorted shale after kerogen decomposition contains substantial amounts of residual carbonaceous material which can be burned to supply heat for retorting.

The recovery of liquid and gaseous products from oil shale deposits has been described in several patents, one of which is U.S. Pat. No. 3,661,423, issued May 9, 1972, to Donald E. Garrett, assigned to the assignee of this application and incorporated herein by reference. This patent describes in situ recovery of liquid and gaseous hydrocarbon materials from a subterranean formation containing oil shale by fragmenting such formation to form a cavity containing a stationary, fragmented permeable body or mass of formation particles containing oil shale within the formation, referred to herein as an in situ oil shale retort. The cavity has bottom, top, and side boundaries of unfragmented formation. Hot retorting gases are passed through the in situ oil shale retort to convert kerogen contained in the oil shale to liquid and gaseous products, thereby producing "retorted oil shale".

The retort can be filled to the top with the fragmented permeable mass of particles, which is also known as a rubble pile. An upper portion of the fragmented permeable mass is ignited and an oxygen supplying gas such as air is forced downwardly through the fragmented permeable mass as a combustion zone feed for combustion of carbonaceous material in the shale. Initially some of the shale oil may be burned, but as retorting progresses, much of the combustion is of residual carbonaceous material remaining in retorted oil shale. This reduces the oxygen content of the oxygen supplying gas and the resultant gas passing downwardly through the retort below the combustion zone is essentially inert, i.e., is substantially free of free oxygen. This inert gas transfers heat downwardly and results in retorting of the oil shale in a retorting zone below the combustion zone without appreciable combustion of shale oil. It will be recognized that the rate of progression of the combustion zone is quite slow and is ordinarily in the order of only a few feet per day.

An operating retort has a combustion zone advancing slowly downwardly through the fragmented mass. This combustion zone is not a thin layer but ordinarily has appreciable thickness due to gradual consumption of oxygen in the downwardly flowing gas and inherent variations in particle size of the oil shale. The primary combustion zone is the portion of the retort where the greater part of the oxygen in the combustion feed that reacts with residual carbonaceous material in retorted oil shale is consumed. Below the primary combustion zone during normal operation is a retorting zone which is heated to a temperature sufficient to decompose the kerogen to produce liquid and gaseous products including liquid and gaseous hydrocarbon products. Above the primary combustion zone is ordinarily a zone of hot combusted oil shale.

It is found that the yield of liquid and gaseous hydrocarbon products from oil shale tends to be maximized when the primary combustion zone extends across the entire fragmented permeable mass and moves through the retort as a substantially planar wave. When the primary combustion zone is not planar, the yield of liquid and gaseous hydrocarbon products from the oil shale tends to be minimized. This minimizing occurs firstly because the oil shale in the upper corners and/or near the side edges of the retort are bypassed by the primary combustion zone and retorting zone and secondly because some of the shale oil produced by one portion of the primary combustion zone can be consumed by oxidation in another portion. In addition, when the primary combustion zone is not planar, excessive cracking of hydrocarbon products produced in the retorting zone can result.

Establishment of a combustion zone in the retort can be effected according to the method described in U.S. Pat. No. 3,990,835, issued Nov. 9, 1976 and U.S. Pat. No. 3,952,801 issued Apr. 27, 1976, both of which were issued to Robert S. Burton III and assigned to the assignee of this application. Both of these patents ae incorporated herein by this reference. U.S. Pat. No. 3,952,801 describes a technique for establishing a combustion zone in a retort by igniting the top of a fragmented permeable mass in the retort. According to this technique, a hole is bored to the top of the fragmented permeable mass and a burner is lowered through the bore hole to the oil shale to be ignited. A mixture of a combustible fuel such as LPG (liquefied petroleum gas) and gas containing oxygen, such as air, is burned in the burner and the resultant flame is directed downwardly towards the fragmented permeable mass. The burning is conducted until a substantial portion of the oil shale has been heated above the self-ignition temperature of carbonaceous material in the oil shale so combustion of oil shale in the fragmented mass is self-sustaining. Then introduction of fuel is terminated, the burner is withdrawn from the retort through the hole, and oxygen supplying gas is introduced to the retort to advance the combustion zone through the retort.

An in situ oil shale retort may have a substantial lateral extent; for example, it may be square with a width of 100 feet or more. Ignition of the top portion of the fragmented permeable mass in a completely filled retort requires access which is ordinarily obtained by forming a conduit through the overlying unfragmented rock. In a relatively smaller retort a single central conduit can be used.

In a larger retort a number of conduits to various top portions of the retort may be preferred. These conduits supply combustion air or other oxygen supplying gas during normal operation of the retort, and their openings into the retort are also used to locate points of ignition for starting the formation of a retorting zone. Since the ignition points are isolated, the top of the retort is inherently nonuniformly ignited.

For purposes of exposition, a single ignition point in the center of a retort can be assumed. A retort with a number of separate ignition points can be considered as a plurality of adjacent smaller retorts, each with a single ignition point. Ignition is obtained by burning a combustible gas with air or other oxygen supplying gas and impinging the flame on the fragmented permeable mass at the opening of the conduit. This heating can be conducted for a substantial period of time so that a sufficient volume of oil shale is heated to sustain combustion after the initial burning is stopped and an oxygen supplying gas such as air is forced down the conduit. The combustion zone that is formed around the ignition point tends to progress downwardly and outwardly. It is driven downwardly by the gas flowing through the retort and progresses laterally primarily by conduction and radiation which are much slower. Substantial unburned portions may be left in the upper corners and/or near the side edges of the retort. The self ignition temperature of the carbonaceous material in oil shale can vary with various conditions such as total gas pressure and the partial pressure of oxygen in the retort, and may be as low as 500° F., although 750° F. is usually considered a minimum. In operation of an in situ retort it is preferred to consider 900° F. as the self ignition temperature since this is a good ignition value. Temperatures in the combustion zone of a retort may be 1200° F. or more.

A combustion zone which is non planar and/or which has advanced through the in situ oil shale retort without the desired lateral spreading will result in a yield of liquid and gaseous hydrocarbon products which is not maximized. It is therefore desirable to provide a technique for establishing a combustion zone in an in situ oil shale retort where the combustion zone is flat and uniformly transverse to its direction of advancement and extends laterally to the boundaries of the retort.

SUMMARY OF THE INVENTION

According to this invention, the yield from an in situ oil shale retort containing a fragmented permeable mass of particles containing oil shale can tend to be maximized by establishing a secondary combustion zone and controlling its location in the fragmented mass.

Practice of principles of this invention can be accomplished by establishing a primary combustion zone in a portion of fragmented permeable mass near the inlet of an in situ oil shale retort. For a first period of time a first retort inlet mixture comprising an oxygen supplying gas is introduced to the fragmented mass near the inlet for sustaining the primary combustion zone and advancing the primary combustion zone through the retort. The primary combustion zone establishes and advances a retorting zone on the advancing side of the primary combustion zone whereby oil shale in the fragmented mass is retorted to produce liquid and gaseous products including liquid and gaseous hydrocarbon products.

The primary combustion zone is monitored with temperature monitoring means to determine whether it is planar, has extended laterally to the edges of the fragmented permeable mass, and/or is progressing uniformly through the retort. It is does not meet such criteria, a secondary combustion zone is established during a second period of time at a first location in the fragmented permeable mass of oil shale. The secondary combustion zone can then be moved upstream in the fragmented permeable mass to a second location, maintained at such second location, and allowed to spread laterally toward the outer edges of the fragmented permeable mass. The secondary combustion zone is maintained at the second location until oil shale in the fragmented mass is heated above the self-ignition temperature of such oil shale. Heating the oil shale to above its self-ignition temperature spreads the primary combustion zone laterally across the fragmented permeable mass at the second location. Thereafter, the secondary combustion zone can be extinguished while introduction of oxygen supplying gas is continued to the retort for sustaining and advancing the primary combustion zone through the retort.

BRIEF DESCRIPTION OF THE DRAWINGS

These and other features, aspects and advantages of the present invention will become more apparent when considered with respect to the following description, appended claims and accompanying drawings where:

DETAILED DESCRIPTION

Figure 1:
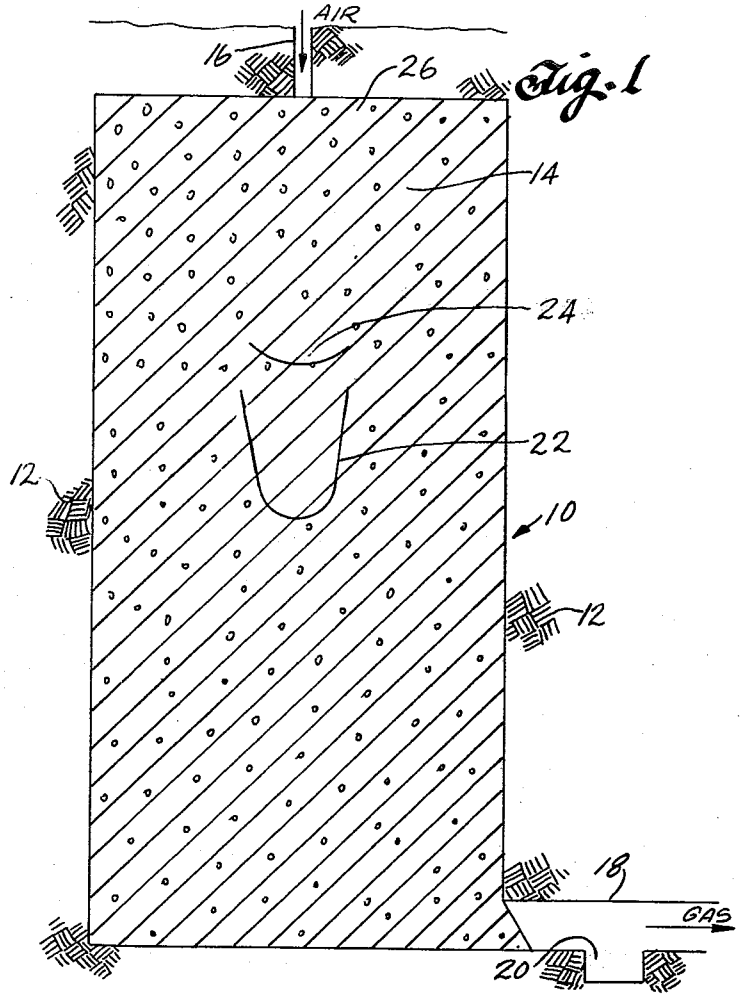
FIG. 1 illustrates semi-schematically in vertical cross section a vertical in situ oil shale retort operated without the practice of this invention.

As illustrated in FIG. 1, an in situ oil shale retort 10 in a subterranean formation 12 containing oil shale is in the form of a room or cavity having top, bottom and side boundaries of unfragmented formation. The cavity contains a fragmented permeable mass 14 of particles containing oil shale. One or more inlet conduits 16 lead through unfragmented formation to the top boundary 26 of the fragmented permeable mass in the retort for introduction of a retort inlet mixture such as air or other oxygen supplying gas to support combustion.

A tunnel or drift 18 is provided at the bottom of the retort as a retort outlet for withdrawal of off gas which includes the products of combustion of carbonaceous material in the oil shale, any gaseous nonreactive portion of the retort inlet mixture, and gaseous products of retorting. A sump 20 is provided as a retort outlet for collecting liquid products including shale oil and water. The bottom of the retort can be closed, i.e., the drift 18 blocked by a bulkhead and the products removed through conduits in the tunnel.

The retort 10 as described is vertical, but the principles of the invention can be practiced using horizontal retorts or retorts positioned at other angles.

In the preferred embodiment, a processing zone is established in an upper portion of the fragmented mass in the vertical in situ retort near the bottom of the inlet conduit 16. The processing zone can be established by any known method such as a method described in either U.S. Pat. No. 3,661,423 or U.S. patent application Ser. No. 929,447 filed July 31, 1978 by me and assigned to the assignee of this application and incorporated herein by this reference. For example, a burner can be lowered into the inlet conduit 16 for heating the upper portion of the fragmented permeable mass. The fragmented permeable mass is heated until a portion is at a temperature greater than the self-ignition temperature of the carbonaceous material in the oil shale which, for example, can be approximately 900° F.

After ignition, an oxygen supplying gas such as air is introduced through the inlet conduit 16 for a first period of time as a first retort inlet mixture, which establishes a primary combustion zone, and causes the primary combustion zone to advance through the retort. The oxygen supplying gas can be air augmented with oxygen or air diluted with recycled off gas or steam. Other oxygen supplying gas can also be used for establishing and sustaining a combustion zone in the fragmented permeable mass.

As used herein, the term "processing zone" refers to a hot portion of the fragmented permeable mass such as a combustion zone and/or a retorting zone. As used herein, the term "retorting zone" refers to the portion of the retort where kerogen in oil shale is being decomposed to liquid and gaseous products leaving residual carbonaceous material in the retorted oil shale. As used herein, the term "primary combustion zone" refers to a portion of the retort where the greater part of the oxygen in the retort inlet mixture that reacts with the residual carbonaceous material in the retorted oil shale is consumed.

The primary combustion zone 22 as illustrated in FIG. 1 has advanced a substantial distance downwardly from the ignition point near the bottom of the inlet conduit 16 with limited lateral spreading. The primary combustion zone 22 and the retorting zone thereby bypass the oil shale in the upper corners and/or along the edges of the fragmented permeable mass in the retort. The kerogen in the upper corners and/or along the edges of the retort is therefore not retorted, which tends to minimize the yield of liquid and gaseous hydrocarbon products.

Preferably, a primary combustion zone is caused to spread laterally near the retort inlet. If, however, lateral spreading near the retort inlet does not occur, practice of principles of this invention can be utilized to solve the problem of minimizing the yield of gaseous and liquid hydrocarbon products caused by the advance of such primary combustion zone with only limited lateral spreading. A primary combustion zone which has moved a suubstantial distance through the retort without desired lateral spreading can be caused to spread laterally and the advance of such primary combustion zone through the retort can be slowed by introducing a second retort inlet mixture during a second period of time through the inlet conduit 16. The second retort inlet mixture comprises a fuel and at least sufficient oxygen for combustion of the fuel for the establishment of a secondary combustion zone at a first location upstream of the trailing side of the primary combustion zone. As used herein, the term "secondary combustion zone" refers to that portion of the retort where the fuel in a retort inlet mixture is consumed.

The establishment of the secondary combustion zone upstream of the primary combustion zone tends to slow the advance of the primary combustion zone through the retort. This principle is discussed in detail in patent application Ser. No. 888,301 titled "METHOD FOR OPERATING AN IN SITU OIL SHALE RETORT HAVING CHANNELLING" filed by me and incorporated herein by this reference.

The location of the secondary combustion zone 24 upstream of the primary combustion zone 22 results in a primary combustion zone feed which must initially pass through the secondary combustion zone. This causes the oxygen in the primary combustion zone feed to be partially depleted by oxidizing the fuel in the retort inlet mixture thereby reducing the mass flow rate of oxygen to the primary combustion zone 22. The reduction of the mass flow rate of oxygen to the primary combustion zone 22 slows or essentially stops the primary combustion zone advance through the retort. As the percentage of fuel added to the retort inlet mixture is increased, the ignition temperature of the mixture is decreased and in addition the mass flow rate of oxygen to the primary combustion zone is further decreased. If desired, sufficient fuel can be introduced into the second retort inlet mixture to substantially consume all of the oxygen introduced, thereby essentially stopping the rate of downward movement of the primary combustion zone.

The mass flow rate of oxygen to the primary combustion zone 22 is also reduced because the pressure gradient across the gas flow path in the region of the fragmented permeable mass between the secondary combustion zone and the primary combustion zone is increased. The increase in the pressure gradient across the region of fragmented permeable mass between the primary combustion zone and the secondary combustion zone is caused by an increase in the temperature in this region due to the establishment of the secondary combustion zone. This increase in temperature causes increased thermal expansion of the particles in the fragmented permeable mass which results in a decrease of the void fraction in the region between the primary combustion zone and the secondary combustion zone. This increase in temperature also causes the extent of thermal fracturing of the fragmented permeable mass to increase in the region of increased temperature, which decreases the average size of the particles. The decrease in the average size of the particles and the decrease in void fraction due to thermal expansion cause a decrease in the permeability of the fragmented permeable mass. The decrease in the permeability of the fragmented permeable mass occurs in the region between the primary combustion zone and the secondary combustion zone resulting in an increase of pressure gradient across the region between the primary combustion zone and the secondary combustion zone.

Two other factors additionally cause an increase in the pressure gradient across the region of fragmented permeable mass between the secondary combustion zone and primary combustion zone. Both the volume and viscosity of the primary combustion zone feed increase as the temperature of the primary combustion zone feed is increased. The temperature of the primary combustion zone feed is increased in the region between the primary combustion zone and secondary combustion zone, due to the establishment of the secondary combustion zone, which increases the pressure gradient across such region. It is axiomatic that the pressure drop from the inlet of the retort to the outlet of the retort is the same regardless of the flow path followed, whereby the increased pressure gradient across the region between the primary combustion zone and secondary combustion zone causes bypassing of this region by the downwardly flowing gas. The bypassing of this region causes the mass flow rate of oxygen in the primary combustion zone feed to the primary combustion zone to be reduced.

Once the secondary combustion zone is established, it heats the fragmented permeable mass upstream of its first location by both conduction and radiation. The secondary combustion zone can be moved to a location upstream of its first location, for example, by maintaining the composition of the retort inlet mixture substantially constant. The secondary combustion zone heats the fragmented permeable mass upstream of its first location until such fragmented permeable mass reaches the ignition temperature of the inlet mixture that has been maintained at the substantially constant composition. The fuel of such retort inlet mixture thereby ignites at a second location establishing the secondary combustion zone upstream of its first location. The process of maintaining the retort inlet mixture at a substantially constant composition can be continued thereby moving the secondary combustion zone slowly upstream with the rate of upstream movement limited by the heating of the upstream fragmented permeable mass. The secondary combustion zone is preferably moved upstream, however, by progressively changing the composition of the retort inlet mixture to progressively reduce the ignition temperature of such retort inlet mixture as, for example, by changing the fuel to oxygen ratio or by changing the chemical composition of the mixture. The temperature upstream of the secondary combustion zone is lower than the ignition temperature of the first retort inlet mixture. A change of the composition of the retort inlet mixture to reduce its ignition temperature will cause the secondary combustion zone to move to the location in the fragmented permeable mass at the lower temperature. This method can be used to move the secondry combustion zone upstream more rapidly than the method of maintaining the composition of the retort inlet mixture substantially constant.

The secondary combustion zone is maintained at an upstream position for spreading the primary combustion zone laterally through an upper portion of the fragmented permeable mass. This is accomplished because the secondary combustion zone heats oil shale in the upper portion of the fragmented permeable mass to the self-ignition temperature of such oil shale. It is preferred that the secondary combustion zone be maintained at the upstream position until the primary combustion zone has spread laterally completely through the fragmented permeable mass to the unfragmented boundary of the retort. The extent of the lateral spreading of the primary combustion zone can be determined by monitoring the oxygen content of the off gas from the retorting operation. When the secondary combustion zone is near the top of the fragmented mass for spreading a primary combustion zone laterally, there may not be complete continuity of the primary combustion zone. That is, the portion of the primary combustion zone that moved downwardly through the fragmented mass may be separated from another portion of the primary combustion zone formed downstream from portions of the secondary combustion zone spreading laterally across the retort. Oxygen containing gas can bypass the primary combustion zone through such discontinuities. Any such discontinuities tend to disappear as the secondary combustion zone is continued and additional oil shale is heated above its ignition temperature. The primary combustion zone tends to coalesce across any such discontinuities. Similarly, when a primary combustion zone does not extend completely across the fragmented permeable mass to the outer boundary of unfragmented formation, a portion of the retort inlet mixture can pass through the retort without passing through a primary combustion zone. The oxygen in this portion of the retort inlet mixture will therefore not be completely depleted, and the percentage of oxygen in the retort off gas can be used to indicate the proportion of the inlet mixture bypassing the combustion zone.

As the primary combustion zone is spread laterally across the fragmented permeable mass by the secondary combustion zone, the portion of the retort inlet mixture which bypasses the primary combustion zone progressively decreases thereby progressively decreasing the percentage of oxygen in the retort off gas. Once the primary combustion zone has spread laterally across the entire fragmented permeable mass, the entire retort inlet mixture passes through the primary combustion zone, thereby depleting the oxygen in the retort inlet mixture. Satisfactory spreading of the primary combustion zone is indicated when the percentage of oxygen in the off gas is less than about 0.8%. The measurement of oxygen in the retort off gas during retorting operations can thereby be used to ascertain the extent of lateral spreading of the primary combustion zone. The secondary combustion zone can be maintained in a position near the top of the fragmented mass until the oxygen concentration in off gas from the retort reaches a predetermined value. For example, the secondary combustion can be maintained until the oxygen concentration in retort off gas decreases to about 0.8% by volume.

When adequate spreading of the combustion zone has occurred, fuel is discontinued or reduced in the retort inlet mixture while the introduction of oxygen supplying gas is continued through the inlet conduit 16. The primary combustion zone, which has spread laterally through the upper portion of the fragmented permeable mass, is advanced downwardly through the fragmented mass in the retort by the continued introduction of oxygen supplying gas.

The principles and techniques used in this invention are further illustrated by referring to FIG. 1. A portion of the fragmented permeable mass of particles is ignitedl, thereby establishing a processing zone including a primary combustion zone 22 in the retort. For a first period of time a first retort inlet mixture comprising an oxygen supplying gas is introduced into the retort at a rate sufficient to advance the primary combustion zone through the fragmented permeable mass. The locus of the processing zone which includes the combustion zone is monitored as it progresses through the retort. A variety of techniques can be used to monitor the locus of the primary combustion zone. Exemplary of such techniques and incorporated herein by this reference is the method described in U.S. Pat. No. 4,082,145 entitled "DETERMINING THE LOCUS OF A PROCESSING ZONE IN AN IN SITU OIL SHALE RETORT BY SOUND MONITORING" assigned to the assignee of this application. By using this or other temperature monitoring techniques, such as by using thermocouples, it can be determined whether the combustion zone is planar, has extended to the edges of the fragmented permeable mass and/or is progressing uniformly downwardly through the retort.

If the primary combustion zone does not meet the above criteria as illustrated by the primary combustion zone 22 of FIG. 1, a secondary combustion zone 24 is established upstream of the primary combustion zone 22. A secondary combustion zone can be established because there is a temperature gradient through the fragmented permeable mass from the top boundary 26 of the fragmented permeable mass downward to the location of the primary combustion zone. This temperature gradient covers a temperature range from about ambient temperature near the top boundary 26 of the fragmented permeable mass to the temperature at the location of the primary combustion zone, for example, which can be about 1800° F. The secondary combustion zone 24 is established by introducing into the retort during a second period of time a retort inlet mixture comprising fuel and at least sufficient oxygen for combustion of the fuel at a temperature no greater than the maximum primary combustion zone temperature. The second retort inlet mixture is ignited between the top boundary 26 and the primary combustion zone at a locus of points in the fragmented permeable mass which is at the ignition temperature of such a mixture. The secondary combustion zone 24 is thereby established at a location upstream of the primary combustion zone. The secondary combustion zone 24 heats the fragmented permeable mass upstream by conduction and radiation and in addition depletes some portion of the oxygen in second retort inlet mixture thereby causing a decrease in the mass flow rate of oxygen to the primary combustion zone. The decrease in the mass flow rate of oxygen to the primary combustion zone slows the advance of the primary combustion zone through the retort.

After the secondary combustion zone is established, a third retort inlet mixture is introduced into the retort during the second period of time, the third retort inlet mixture having a higher proportion of fuel than the second retort inlet mixture. The increase in the percentage of fuel in the third retort inlet mixture causes the ignition temperature of the third retort inlet mixture to be less than the ignition temperature of the second retort inlet mixture. The increase in the percentage of fuel in the third retort inlet mixture also causes an increase in the depletion of oxygen thereby reducing further the mass flow rate of oxygen to the primary combustion zone. The reduction of the spontaneous ignition temperature of the third retort inlet mixture causes the secondary combustion zone to move to a second location upstream from the first location and can cause an additional slowing of the advance of the primary combustion zone through the retort. The secondary combustion zone can be caused to move further upstream to a desired location by introducing a series of retort inlet mixtures, each progressive retort inlet mixture in the series having a lower ignition temperature than the preceding retort inlet mixture.

Figure 2:
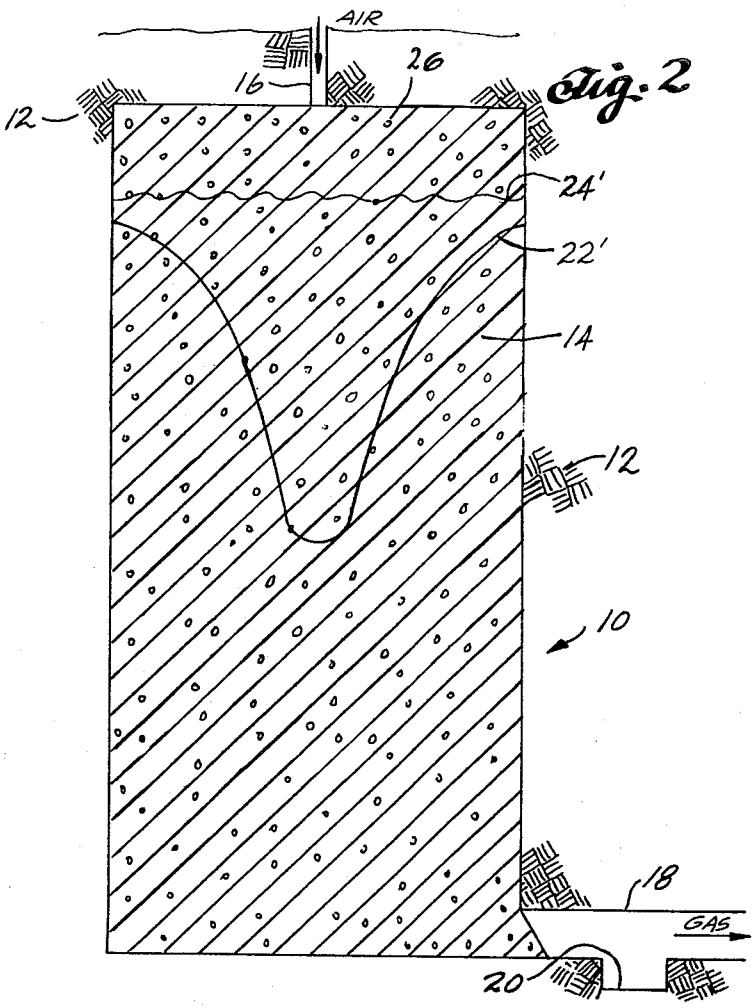
FIG. 2 illustrates the same retort operated in accordance with this invention.

The secondary combustion zone 24', as illustrated by FIG. 2, is maintained at a desired location which causes such secondary combustion zone to spread laterally outwardly toward the boundary of the unfragmented formation. The secondary combustion zone 24' heats the fragmented permeable mass at the desired location to the self-ignition temperature of carbonaceous material in the oil shale which spreads the primary combustion zone 22 laterally.

When adequate spreading of the primary combustion zone has occurred based on the evaluation of oxygen content in the retort off gas or by other means such as by temperature monitoring, fuel can be discontinued to the secondary combustion zone while the oxygen supplying gas is continued to be introduced into the retort. The primary combustion zone 22' has been spread laterally across the upper portion of the fragmented permeable mass enabling retorting of the upper corners and/or outer edges of the oil shale retort which had initially been bypassed by the primary combustion zone 22.

Thus, practice of the principles of this invention tends to maximize the yield of liquid and gaseous products from the oil shale retort.

The following example will further illustrate practice of this invention. A primary combustion zone was initially established in a vertical in situ oil shale retort about 35 feet square and 94 feet high as shown in FIGS. 1 and 2. A primary combustion zone was established by heating the fragmented permeable mass using a burner which was lowered through the inlet conduit 16. A mixture of LPG (liquefied petroleum gas) and air was burned and the resultant flame directed downwardly toward the fragmented permeable mass 14. The burning was continued until a portion of the carbonaceous material had been heated above its self ignition temperature of about 900° F. The introduction of LPG was then discontinued, the burner withdrawn, and for a first period of time a first retort inlet mixture containing oxygen was introduced into the retort to advance the primary combustion zone downwardly through the fragmented permeable mass. Within three days the primary combustion zone 22 had progressed downwardly to a level about 43 feet below the top boundary 26 of the fragmented permeable mass. The expected rate of travel of a primary combustion zone, based on conditions as had been established, was approximately 0.5 to 2.0 feet per day. It was determined by thermocouple temperature monitoring means that the primary combustion zone 22 was not substantially planar, but had progressed rapidly downwardly in the center of the retort with very little lateral spreading. It is believed that the combustion zone in the fragmented permeable mass resembled the schematic representation of the combustion zone 22 illustrated in FIG. 1. The advance of the primary combustion zone with the limited lateral spreading resulted in significant volumes of unretorted oil shale remaining in the upper portions of the fragmented permeable mass above the primary combustion zone.

To effect recovery of the liquid and gaseous hydrocarbon products in the unretorted upper regions of the fragmented permeable mass, a secondary combustion zone 24 was established by introducing for a second period of time a second retort inlet mixture through the inlet conduit 16 comprising LPG and air. The fuel to oxygen ratio in the second retort inlet mixture was such that the spontaneous ignition temperature of this mixture was approximately 1100° F., which was less than the maximum primary combustion zone temperature of approximately 1800° F. The secondary combustion zone 24 was thereby established at a locus in the fragmented permeable mass which was at approximately 1100° F. The second retort inlet mixture was initially about 1.1% LPG concentration by volume, and was comprised of about 693 standard cubic feet per minute (SCFM) of air and 7.5 SCFM of LPG. The secondary combustion zone was initially established at a location in the retort about 27 feet from the top of the fragmented permeable mass, and upstream of the primary combustion zone 22.

The establishment of the secondary combustion zone at this location caused the second retort inlet mixture to pass through the secondary combustion zone before being introduced into the primary combustion zone as a primary combustion zone feed. The oxygen content of the primary combustion zone feed was thereby reduced, causing the mass flow rate of oxygen in the gas introduced into the primary combustion zone to be reduced. This reduction in mass flow rate of oxygen into the primary combustion zone caused a reduction in the rate of advance of the primary combustion zone downwardly through the retort. The downwardly flowing second retort inlet mixture moved the heat produced by the secondary combustion zone downstream by convection. The heat generated by the secondary combustion zone was however greater than that removed by the downward flowing second retort inlet mixture, which caused the spent shale and carbonaceous material upstream of the secondary combustion zone to be heated by conduction and radiation from the secondary combustion zone.

Thereafter, during the second period of time, a third retort inlet mixture was introduced having a composition different from that of the second retort inlet mixture, resulting in the ignition temperature of the third retort inlet mixture being less than the ignition temperature of the second retort inlet mixture. This change in the composition of the retort inlet mixture can be accomplished by several methods, one of which as used in this example, was to progressively increase the percentage of LPG in the second retort inlet mixture. The progressive increase in the percentage of fuel and consequent progressive reduction of the ignition temperature of the second retort inlet mixture caused the secondary combustion zone to move progressively upstream from its first location to a location where the fragmented permeable mass was at the ignition temperature of each successive retort inlet mixture. The increase in the percentage of LPG in each progressive retort inlet mixture also caused a further depletion of oxygen and resulted in further progressive decreases in the mass flow rate of oxygen to the primary combustion zone. This additional decrease in mass flow rate of oxygen to the primary combustion zone caused further progressive decreases in the rate of advance of the primary combustion zone through the retort.

The changes in the composition of the retort inlet mixture during the second period of time and the resultant changes in spontaneous ignition temperatures caused the secondary combustion zone to progressively move upstream in the retort to the second location near the top boundary 26 of the fragmented permeable mass.

The changes in the composition of the retort inlet mixture were made by progressively increasing the percentage of LPG in such retort inlet mixture from the initial concentration of about 1.1% by volume to a final concentration of approximately about 2.5%. This caused the secondary combustion zone 24 to move to a locus approximately 15 feet below the top of the fragmented permeable mass and upstream of the primary combustion zone. The spontaneous ignition temperature of the retort inlet mixture and therefore the locus of the secondary combustion zone 24' in the fragmented permeable mass at the 15 feet level was at approximately 1000° F.

In the preceding example, the secondary combustion zone 24' could not readily be moved any higher in the retort than about 15 feet below the top boundary 26 of the fragmented permeable mass because the fragmented mass above the 15 foot level and more especially above about the 10 foot level had a small void fraction and was therefore insufficiently permeable to the inlet gas mixture for lateral spread of the primary combustion zone.

The secondary combustion zone 24' was maintained at about the 15 foot level and the retort inlet mixture continued to be introduced into the retort with approximately 2.5% by volume concentration of LPG. The secondary combustion zone thereby spread laterally across the fragmented permeable mass and heated the upper portions of the fragmented permeable mass to a temperature above the self-ignition temperature of the carbonaceous material contained therein. The heating of the carbonaceous material to above its self-ignition temperature spread the primary combustion zone 22' laterally across the fragmented permeable mass.

The extent of lateral spreading of the primary combustion zone was determined by measuring the volume percent of oxygen in the retort off gas. At the time of establishment of the secondary combustion zone, the percentage of oxygen in the retort off gas was about 6%. The secondary combustion zone was maintained for about 13 days, during which time the percentage of oxygen in the retort off gas progressively decreased to about 1.5%. When the percentage of oxygen in the retort off gas had been reduced to 1.5%, the flow of LPG to the secondary combustion zone was discontinued while the flow of air was maintained. The secondary combustion zone 24' was thereby extinguished after the primary combustion zone 22' had been spread laterally across the fragmented permeable mass to near the boundary of unfragmented formation. The primary combustion zone 22' was thereafter caused to move downwardly through the fragmented permeable mass including the previously unretorted portions of fragmented permeable mass by continued introduction of the air.

The establishment and positioning of a secondary combustion zone had thereby enabled retorting of oil shale in the bypassed portions of fragmented permeable mass tending to maximize the yield of liquid and gaseous hydrocarbon products from the retort.

Although this invention has been described in considerable detail with reference to certain versions thereof, other versions are within the scope of this invention. Because of this, the spirit and scope of the appended claims should not necessarily be limited to the description of the preferred versions contained herein.

What is claimed is:

1. In a method for recovering liquid and gaseous hydrocarbon products from an in situ oil shale retort containing a fragmented permeable mass of particles containing oil shale, the fragmented mass having a gas flow path between a retort inlet and a retort outlet, the method comprising the steps of:

establishing a primary combustion zone in a portion of the fragmented permeable mass near the retort inlet;

for a first period of time introducing a first retort inlet mixture comprising an oxygen supplying gas to the fragmented permeable mass through the retort inlet for sustaining the primary combustion zone; and withdrawing an off gas from the fragmented mass through a retort outlet whereby gas flow from the retort inlet toward the retort outlet advances the primary combustion zone through the fragmented permeable mass and advances a retorting zone through the fragmented permeable mass on the advancing side of the primary combustion zone whereby oil shale in the retorting zone is retorted to produce liquid and gaseous hydrocarbon products, the improvement comprising;

for a second period of time introducing a second retort inlet mixture into the retort, the second retort inlet mixture comprising fuel and at least sufficient oxygen for combustion of the fuel, the second retort inlet mixture having an ignition temperature no greater than the primary combustion zone temperature, for establishing a secondary combustion zone at a first location in the fragmented mass upstream of the primary combustion zone; and during the second period of time moving the secondary combustion zone to a second location in the fragmented mass.

2. The method according to claim 1 wherein during the second period of time a third retort inlet mixture is introduced into the retort, the third retort inlet mixture comprising fuel and at least sufficient oxygen for combustion of the fuel at the second location in the fragmented mass, the ignition temperature of the third retort inlet mixture being less than the ignition temperature of the second retort inlet mixture.

3. The method according to claim 2 wherein the fuel to oxygen ratio of the third retort inlet mixture is different from the fuel to oxygen ratio of the second retort inlet mixture.

4. The method according to claim 2 wherein the chemical composition of the third retort inlet mixture is different from the chemical composition of the second retort inlet mixture.

5. The method according to claim 2 in which the ignition temperature of the second retort inlet mixture is progressively reduced by progressively increasing the proportion of fuel in such second retort inlet mixture for forming the third retort inlet mixture.

6. The method according to either of claims 1 or 2 wherein the second location is upstream of the first location.

7. The method according to claim 1 wherein the secondary combustion zone is maintained at the second location until the percentage of oxygen in off gas from the retort reaches a predetermined value.

8. In a method for controlling the location of a secondary combustion zone in an in situ oil shale retort containing a fragmented permeable mass of particles containing oil shale, the method comprising the steps of:

establishing a primary combustion zone in a portion of the fragmented permeable mass near a retort inlet;

for a first period of time introducing a first retort inlet mixture comprising an oxygen-supplying gas to the fragmented permeable mass through the retort inlet for sustaining the primary combustion zone, the improvement comprising:

for a second period of time introducing into the retort a second retort inlet mixture comprising fuel and at least sufficient oxygen for combustion of the fuel, thereby forming a secondary combustion zone at a first location in the fragmented permeable mass upstream of the primary combustion zone; and during the second period of time introducing into the retort a third retort inlet mixture comprising fuel and at least sufficient oxygen for combustion of the fuel, thereby moving the secondary combustion zone to a second location in the fragmented permeable mass.

9. The method according to claim 8 wherein the second retort inlet mixture has an ignition temperature no greater than the primary combustion zone temperature so that combustion of the second retort inlet mixture occurs at a first location in the fragmented permeable mass of particles upstream of the primary combustion zone.

10. The method according to claim 8 wherein the second location is upstream of the first location in the fragmented permeable mass.

11. The method according to claim 8 wherein the proportion of fuel in the second retort inlet mixture is progressively increased for forming the third retort inlet mixture, thereby progressively moving the secondary combustion zone from the first location to the second location.

12. The method according to claim 8 wherein the ignition temperature of the third retort inlet mixture is less than the ignition temperature of the second retort inlet mixture.

13. The method according to claim 8 wherein the fuel to oxygen ratio of the third retort inlet mixture is different from the fuel to oxygen ratio of the second retort inlet mixture.

14. The method according to claim 8 wherein the chemical composition of the third retort inlet mixture is different from the chemical composition of the second retort inlet mixture.

15. The method according to claim 8 wherein the secondary combustion zone is maintained at the second location until the percentage of oxygen in off gas from the retort reaches a predetermined value.

16. A method for operating an in situ oil shale retort containing a fragmented permeable mass of particles containing oil shale comprising the steps of:

establishing a primary combustion zone in a portion of the fragmented permeable mass near a retort inlet;

for a first period of time introducing a first retort inlet mixture comprising an oxygen-supplying gas to the fragmented mass through the retort inlet for sustaining the primary combustion zone and advancing the primary combustion zone through the fragmented mass;

for a second period of time introducing a second retort inlet mixture comprising fuel and at least sufficient oxygen for combustion of the fuel to the fragmented mass to establish a secondary combustion zone at a first location in the fragmented mass and sustain the primary combustion zone; and during the second period of time introducing a third retort inlet mixture comprising fuel and at least sufficient oxygen for combustion of the fuel to the fragmented mass to sustain the primary combustion zone and move the secondary combustion zone to a second location in the fragmented mass.

17. The method according to claim 16 wherein the second retort inlet mixture has an ignition temperature no greater than the maximum primary combustion zone temperature so that combustion of the second retort inlet mixture occurs at a first location upstream of the primary combustion zone.

18. The method according to claim 16 wherein the proportion of fuel in the second retort inlet mixture is progressively increased for forming the third retort inlet mixture, thereby progressively moving the secondary combustion zone from the first location to the second location.

19. The method according to claim 16 wherein the third retort inlet mixture comprises fuel and at least sufficient oxygen for combustion of the fuel at a second location in the fragmented mass upstream from the first location.

20. The method according to claim 19 wherein the ignition temperature of the third retort inlet mixture is less than the ignition temperature of the second retort inlet mixture.

21. The method according to claim 19 wherein the fuel to oxygen ratio of the third retort inlet mixture is different from the fuel to oxygen ratio of the second retort inlet mixture.

22. The method according to claim 19 wherein the chemical composition of the third retort inlet mixture is different from the chemical composition of the second retort inlet mixture.

23. The method according to claim 16 wherein the secondary combustion zone is maintained at the second location until the percentage of oxygen in off gas from the retort reaches a predetermined value.

24. The method for establishing and controlling the location of a secondary combustion zone in an in situ oil shale retort containing a fragmented permeable mass of particles containing oil shale, the fragmented mass having a gas flow path between a retort inlet and a retort outlet, the method comprising the steps of:

establishing a primary combustion zone in the in situ oil shale retort;

for a first period of time introducing a first retort inlet mixture comprising an oxygen supplying gas to the fragmented permeable mass through the retort inlet for advancing the primary combustion zone through the fragmented mass;

for a second period of time introducing a second retort inlet mixture containing fuel and at least sufficient oxygen for combustion of the fuel into the retort on the trailing side of the primary combustion zone for establishing a secondary combustion zone in the fragmented mass at a first location in the fragmented mass upstream from the primary combustion zone; and during the second period of time progressively reducing the ignition temperature of the second retort inlet mixture for moving the secondary combustion zone toward a second location upstream from the first location.

25. The method according to claim 24 wherein the ignition temperature of the second retort inlet mixture is reduced by changing the composition of the second retort inlet mixture.

26. The method according to claim 24 wherein the composition of the second retort inlet mixture is changed by changing the fuel to oxygen ratio of the second retort inlet mixture.

27. The method according to claim 24 wherein the composition of the second retort inlet mixture is changed by changing the chemical composition of the second retort inlet mixture.

28. The method according to claim 24 wherein the secondary combustion zone is moved to the second location and maintained at such second location until the percentage of oxygen in off gas from the retort reaches a predetermined value.

29. A method for establishing and controlling the location of a secondary combustion zone in an in situ oil shale retort containing a fragmented permeable mass of particles containing oil shale, the fragmented mass having a gas flow path between a retort inlet and a retort outlet, the method comprising the steps of:

establishing a primary combustion zone in the in situ oil shale retort;

for a first period of time introducing a first retort inlet mixture comprising an oxygen supplying gas to the fragmented permeable mass through the retort inlet for advancing the primary combustion zone through the fragmented mass;

for a second period of time introducing a second retort inlet mixture containing fuel and at least sufficient oxygen for combustion of the fuel into the retort on the trailing side of the primary combustion zone for establishing a secondary combustion zone in the fragmented mass at a first location in the fragmented mass upstream from the primary combustion zone; and during the second period of time progressively moving the secondary combustion zone upstream from the first location in the fragmented mass.

30. The method according to claim 29 wherein the ignition temperature of the second retort inlet mixture is progressively reduced.

31. The method according to claim 30 wherein the ignition temperature is progressively reduced by changing the composition of the second retort inlet mixture.

32. The method according to claim 31 wherein the composition is changed by changing the fuel to oxygen ratio of the second retort inlet mixture.

33. The method according to claim 31 wherein the composition is changed by changing the chemical composition of the second retort inlet mixture.

34. The method according to claim 29 wherein during the second period of time the secondary combustion zone is moved upstream to a second location and maintained at the second location until the percentage of oxygen in off gas from the retort reaches a predetermined value.

35. A method for establishing and controlling the location of a secondary combustion zone in an in situ oil shale retort containing a fragmented permeable mass of particles containing oil shale, the fragmented mass having a gas flow path between a retort inlet and a retort outlet, the method comprising the steps of:

establishing a primary combustion zone in the in situ oil shale retort;

for a first period of time introducing a first retort inlet mixture comprising an oxygen supplying gas to the fragmented permeable mass through the retort inlet for advancing the primary combustion zone through the fragmented mass;

for a second period of time introducing a second retort inlet mixture containing fuel and at least sufficient oxygen for combustion of the fuel into the retort on the trailing side of the primary combustion zone for establishing a secondary combustion zone in the fragmented mass at a first location in the fragmented mass upstream from the primary combustion zone;

during the second period of time progressively moving the secondary combustion zone to a second location upstream from the first location in the fragmented mass by progressively reducing the ignition temperature of the second retort inlet mixture; and maintaining the secondary combustion zone at the second location until the percentage of oxygen in off gas from the retort reaches a predetermined value.

36. A method for operating an in situ oil shale retort containing a fragmented permeable mass of particles containing oil shale comprising the steps of:

establishing a primary combustion zone in a portion of the fragmented permeable mass near a retort inlet;

introducing a retort inlet mixture comprising fuel and at least sufficient oxygen for combustion of the fuel to establish a secondary combustion zone in the fragmented permeable mass upstream of the primary combustion zone; and extinguishing the secondary combustion zone by discontinuing introduction of the fuel in the retort inlet mixture when the percentage of oxygen in off gas from the retort reaches a predetermined value.

37. The method according to claim 36 wherein the predetermined value of oxygen in off gas from the retort is less than about 0.8%.

38. In a method for controlling the location of a secondary combustion zone in an in situ oil shale retort containing a fragmented permeable mass of particles containing oil shale, the method comprising the steps of:

establishing a primary combustion zone in a portion of the fragmented permeable mass near a retort inlet;

for a first period of time introducing a first retort inlet mixture comprising an oxygen supplying gas to the fragmented permeable mass through the retort inlet for sustaining the primary combustion zone, the improvement comprising:

for a second period of time introducing into the retort a second retort inlet mixture comprising fuel and at least sufficient oxygen for combustion of the fuel, the second retort inlet mixture having an ignition temperature no greater than the primary combustion zone temperature so that combustion of the second retort inlet mixture occurs at a first location in the fragmented permeable mass of particles forming a secondary combustion zone at such a first location in the fragmented permeable mass of particles upstream of the primary combustion zone; and during the second period of time introducing into the retort a third retort inlet mixture comprising fuel and at least sufficient oxygen for combustion of the fuel, thereby moving the secondary combustion zone to a second location in the fragmented mass.

39. In a method for controlling the location of a secondary combustion zone in an in situ oil shale retort containing a fragmented permeable mass of particles containing oil shale, the method comprising the steps of:

establishing a primary combustion zone in a portion of the fragmented permeable mass near a retort inlet;

for a first period of time introducing a first retort inlet mixture comprising an oxygen supplying gas to the fragmented permeable mass through the retort inlet for sustaining the primary combustion zone, the improvement comprising:

for a second period of time introducing into the retort a second retort inlet mixture comprising fuel and at least sufficient oxygen for combustion of the fuel, thereby forming a secondary combustion zone at a first location in the fragmented mass; and during the second period of time progressively increasing the proportion of fuel in the second retort inlet mixture for progressively moving the secondary combustion zone from the first location to a second location in the fragmented permeable mass.

40. In a method for controlling the location of a secondary combustion zone in an in situ oil shale retort containing a fragmented permeable mass of particles containing oil shale, the method comprising the steps of:

establishing a primary combustion zone in a portion of the fragmented permeable mass near a retort inlet;

for a first period of time introducing a first retort inlet mixture comprising an oxygen supplying gas to the fragmented permeable mass through the retort inlet for sustaining the primary combustion zone, the improvement comprising:

for a second period of time introducing into the retort a second retort inlet mixture comprising fuel and at least sufficient oxygen for combustion of the fuel, thereby forming a secondary combustion zone at a first location in the fragmented mass; and during the second period of time introducing into the retort a third retort inlet mixture comprising fuel and at least sufficient oxygen for combustion of the fuel, wherein the ignition temperature of the third retort inlet mixture is less than the ignition temperature of the second retort inlet mixture, thereby moving the secondary combustion zone to a second location in the fragmented mass.

41. In a method for controlling the location of a secondary combustion zone in an in situ oil shale retort containing a fragmented permeable mass of particles containing oil shale, the method comprising the steps of:

establishing a primary combustion zone in a portion of the fragmented permeable mass near a retort inlet;

for a first period of time introducing a first retort inlet mixture comprising an oxygen supplying gas to the fragmented permeable mass through the retort inlet for sustaining the primary combustion zone, the improvement comprising:

for a second period of time introducing into the retort a second retort inlet mixture comprising fuel and at least sufficient oxygen for combustion of the fuel, thereby forming a secondary combustion zone at a first location in the fragmented mass; and during the second period of time introducing into the retort a third retort inlet mixture comprising fuel and at least sufficient oxygen for combustion of the fuel, thereby moving the secondary combustion zone to a second location in the fragmented mass, wherein the fuel to oxygen ratio of the third retort inlet mixture is different from the fuel to oxygen ratio of the second retort inlet mixture.

42. In a method for controlling the location of a secondary combustion zone in an in situ oil shale retort containing a fragmented permeable mass of particles containing oil shale, the method comprising the steps of:

establishing a primary combustion zone in a portion of the fragmented permeable mass near a retort inlet;

for a first period of time introducing a first retort inlet mixture comprising an oxygen supplying gas to the fragmented permeable mass through the retort inlet for sustaining the primary combustion zone, the improvement comprising:

for a second period of time introducing into the retort a second retort inlet mixture comprising fuel and at least sufficient oxygen for combustion of the fuel, thereby forming a secondary combustion zone at a first location in the fragmented mass; and during the second period of time introducing into the retort a third retort inlet mixture comprising fuel and at least sufficient oxygen for combustion of the fuel, wherein the chemical composition of the third retort inlet mixture is different from the chemical composition of the second retort inlet mixture, thereby moving the secondary combustion zone to a second location in the fragmented mass.

43. A method for operating an in situ oil shale retort containing a fragmented permeable mass of particles containing oil shale comprising the steps of:

establishing a primary combustion zone in a portion of the fragmented permeable mass near a retort inlet;

for a first period of time introducing a first retort inlet mixture comprising an oxygen supplying gas to the fragmented mass through the retort inlet for sustaining the primary combustion zone and advancing the primary combustion zone through the fragmented mass;

for a second period of time introducing a second retort inlet mixture comprising fuel and at least sufficient oxygen for combustion of the fuel, wherein the second retort inlet mixture has an ignition temperature no greater than the maximum primary combustion zone temperature so that combustion of the second retort inlet mixture occurs to establish a secondary combustion zone at a first location in the fragmented mass upstream of the primary combustion zone; and during the second period of time introducing a third retort inlet mixture comprising fuel and at least sufficient oxygen for combustion of the fuel to move the secondary combustion zone to a second location in the fragmented mass.

44. A method for operating an in situ oil shale retort containing a fragmented permeable mass of particles containing oil shale comprising the steps of:

establishing a primary combustion zone in a portion of the fragmented permeable mass near a retort inlet;

for a first period of time introducing a first retort inlet mixture comprising an oxygen supplying gas to the fragmented mass through the retort inlet for sustaining the primary combustion zone and advancing the primary combustion zone through the fragmented mass;

for a second period of time introducing a second retort inlet mixture comprising fuel and at least sufficient oxygen for combustion of the fuel to establish a secondary combustion zone at a first location in the fragmented mass; and during the second period of time progressively increasing the proportion of fuel in the second retort inlet mixture for progressively moving the secondary combustion zone from the first location to a second location in the fragmented permeable mass.

45. A method for operating an in situ oil shale retort containing a fragmented permeable mass of particles containing oil shale comprising the steps of:

establishing a primary combustion zone in a portion of the fragmented permeable mass near a retort inlet;

for a first period of time introducing a first retort inlet mixture comprising an oxygen supplying gas to the fragmented mass through the retort inlet for sustaining the primary combustion zone and advancing the primary combustion zone through the fragmented mass;

for a second period of time introducing a second retort inlet mixture comprising fuel and at least sufficient oxygen for combustion of the fuel to establish a secondary combustion zone at a first location in the fragmented mass; and during the second period of time introducing a third retort inlet mixture comprising fuel and at least sufficient oxygen for combustion of the fuel at a second location in the fragmented mass, upstream from the first location, wherein the ignition temperature of the third retort inlet mixture is less than the ignition temperature of the second retort inlet mixture, to move the secondary combustion zone to the second location in the fragmented mass.

46. A method for operating an in situ oil shale retort containing a fragmented permeable mass of particles containing oil shale comprising the steps of:

establishing a primary combustion zone in a portion of the fragmented permeable mass near a retort inlet;

for a first period of time introducing a first retort inlet mixture comprising an oxygen supplying gas to the fragmented mass through the retort inlet for sustaining the primary combustion zone and advancing the primary combustion zone through the fragmented mass;

for a second period of time introducing a second retort inlet mixture comprising fuel and at least sufficient oxygen for combustion of the fuel to establish a secondary combustion zone at a first location in the fragmented mass; and during the second period of time introducing a third retort inlet mixture comprising fuel and at least sufficient oxygen for combustion of the fuel at a second location in the fragmented mass, upstream from the first location, to move the secondary combustion zone to the second location in the fragmented mass, and wherein the fuel to oxygen ratio of the third retort inlet mixture is different from the fuel to oxygen ratio of the second retort inlet mixture.

47. A method for operating an in situ oil shale retort containing a fragmented permeable mass of particles containing oil shale comprising the steps of:

establishing a primary combustion zone in a portion of the fragmented permeable mass near a retort inlet;

for a first period of time introducing a first retort inlet mixture comprising an oxygen supplying gas to the fragmented mass through the retort inlet for sustaining the primary combustion zone and advancing the primary combustion zone through the fragmented mass;

for a second period of time introducing a second retort inlet mixture comprising fuel and at least sufficient oxygen for combustion of the fuel to establish a secondary combustion zone at a first location in the fragmented mass upstream of the primary combustion zone; and during the second period of time introducing a third retort inlet mixture comprising fuel and at least sufficient oxygen for combustion of the fuel at a second location in the fragmented mass, upstream from the first location, to move the secondary combustion zone to the second location in the fragmented mass, and wherein the chemical composition of the third retort inlet mixture is different from the chemical composition of the second retort inlet mixture.

48. A method for operating an in situ oil shale retort containing a fragmented permeable mass of particles containing oil shale comprising the steps of:

establishing a primary combustion zone in a portion of the fragmented permeable mass near a retort inlet;

introducing a retort inlet mixture comprising fuel and at least sufficient oxygen for combustion of the fuel to establish a secondary combustion zone in the fragmented permeable mass; and extinguishing the secondary combustion zone by discontinuing introduction of the fuel in the retort inlet mixture when the percentage of oxygen in off gas from the retort reaches a predetermined value, wherein the predetermined value of oxygen in off gas from the retort is less than about 0.8%.

* * * * *